US008939463B2

(12) United States Patent
Mendoza

(10) Patent No.: US 8,939,463 B2
(45) Date of Patent: Jan. 27, 2015

(54) INDIVIDUAL SNOWBOARDS FOR EACH FOOT

(76) Inventor: Albert Mendoza, Santa Monica, CA (US)

( * ) Notice: Subject to any disclaimer, the term of this patent is extended or adjusted under 35 U.S.C. 154(b) by 202 days.

(21) Appl. No.: 13/298,256

(22) Filed: Nov. 16, 2011

(65) Prior Publication Data

US 2013/0015638 A1 Jan. 17, 2013

Related U.S. Application Data

(60) Provisional application No. 61/506,576, filed on Jul. 11, 2011.

(51) Int. Cl.

*A63C 5/00* (2006.01)
*A63C 5/03* (2006.01)
*A63C 5/02* (2006.01)

(52) U.S. Cl.

CPC ... *A63C 5/03* (2013.01); *A63C 5/02* (2013.01); *A63C 2203/02* (2013.01)
USPC ..... 280/600; 280/609

(58) Field of Classification Search

CPC ..... A63C 5/03; A63C 5/0405; A63C 5/003; A63C 5/07; A63C 9/003; A63C 5/126; A63C 5/12; A63C 5/052; A63C 5/0422; A63C 5/02; A63C 5/075; A63C 10/14; A63C 5/006; A63C 5/048; A63C 5/0485; A63C 5/128; A63C 1/32; A63C 2009/008; A63C 2203/06; A63C 5/0411; A63C 5/0417; A63C 5/044; A63C 10/18; A63C 1/303; A63C 2203/46; A63C 5/031; A63C 5/0428; A63C 9/005; A63C 9/0807; A63C 10/16; A63C 10/20; A63C 17/018; A63C 17/18; A63C 1/36; A63C 2203/02; A63C 2203/08; A63C 2203/12; A63C 2203/40; A63C 5/062; A63C 5/122; A63C 7/06; A63C 7/1066; A63C 9/00; A63C 10/005; A63C 10/02; A63C 10/04; A63C 10/24; A63C 13/003; A63C 13/005; A63C 17/0046; A63C 17/02; A63C 17/06; A63C 1/30; A63C 1/306; A63C 1/34; A63C 2201/02; A63C 2201/06; A63C 2203/10; A63C 2203/14; A63C 2203/20; A63C 2203/54; A63C 3/00; A63C 3/12; A63C 5/00; A63C 5/033; A63C 5/0434; A63C 5/056; A63C 5/1247; A63C 5/1026; A63C 7/1033; A63C 7/108; A63C 9/001; A63C 9/006; A63C 9/007; A63C 9/02; A63C 9/085; A63C 9/20; B63B 35/81; B63B 35/7906; B63B 35/7909; B63B 2231/50; B63B 59/02; B63B 13/043; B63B 13/10; B63B 17/06; B63B 17/065; A43B 3/163; A43B 3/18; A63G 31/007; B62B 13/043; B62B 13/10; B62B 17/06; B62B 17/065; B32B 1/04; B32B 1/06; B32B 3/30; B32B 5/18; B60G 17/015; B60G 2300/322; B62J 25/00; B62M 27/02
USPC ..... 280/11.12, 600, 601, 607, 609, 14.21, 280/845

See application file for complete search history.

(56) References Cited

U.S. PATENT DOCUMENTS 3,272,522 A * 9/1966 Kennedy, III ..... 280/610
4,188,046 A * 2/1980 Fleckenstein ..... 280/618

(Continued)

*Primary Examiner* — J. Allen Shriver, II
*Assistant Examiner* — Bridget Avery
(74) *Attorney, Agent, or Firm* — Kafantaris Law Offices; Theo Kafantaris

(57) ABSTRACT

An improved individual snowboard for each foot is described having several improvements over the prior art relating to safety, stability, and performance. Each snowboard comprises a curved up nose and tail, a base, and a common sidewall surrounding the perimeter of the board. A resilient tapered core is disposed between the base, but not through the nose and tail, to provide additional flex when needed. The width of the nose is larger than the width of the tail for maneuverability and changing stances. The user will stand on both boards perpendicular to the sidewalls, with each nose pointing outward and each tail pointing inward. Angled sidecuts assist in stopping and turning, while a raised camber provides a smoother ride while adding more edge for better stopping, turning, and control.

19 Claims, 6 Drawing Sheets

(56) References Cited

U.S. PATENT DOCUMENTS

| | | | | | |
|---|---|---|---|---|---|
| 4,705,291 | A * | 11/1987 | Gauer | 280/609 |
| 5,320,378 | A * | 6/1994 | Wiig | 280/610 |
| D383,824 | S * | 9/1997 | Mendoza et al. | D21/760 |
| 5,799,956 | A * | 9/1998 | Shannon | 280/14.21 |
| 6,244,615 | B1 * | 6/2001 | Mendoza et al. | 280/600 |
| D485,881 | S * | 1/2004 | Adamczewski et al. | D21/766 |
| 7,159,875 | B2 * | 1/2007 | Seymour | 280/14.21 |
| 2004/0100067 | A1 * | 5/2004 | Riepler et al. | 280/602 |
| 2006/0097484 | A1 * | 5/2006 | Walker | 280/600 |
| 2011/0079986 | A1 * | 4/2011 | Gradman et al. | 280/609 |

* cited by examiner

INDIVIDUAL SNOWBOARDS FOR EACH FOOT

CROSS-REFERENCE TO RELATED APPLICATIONS

This application claims the benefit of U.S. Provisional Patent Application No. 61/506,576, filed on Jul. 11, 2011, and incorporated herein by reference.

STATEMENT REGARDING FEDERALLY SPONSORED RESEARCH AND DEVELOPMENT

Not Applicable.

FIELD OF THE INVENTION

This invention relates to outdoor recreational equipment, and more particularly, to individual snowboards that attach to each foot for use on snow-covered surfaces.

DISCUSSION OF RELATED ART

Snowboards are a form of recreational equipment intended to be used outdoors on a snow-covered surface. A snowboard is a board adapted to glide on snow. While several stances may be used, the user will typically stand on the board with both feet and travel transverse to their foot position. Snowboards vary in shape and size depending on the skill level of the user, snow conditions, and riding style.

A snowskate is a hybrid between a skateboard and a snowboard. Snowskates are generally intended to allow for skateboard tricks on the snow. As such, they do not have boot bindings and include grooves cut into the bottom. A snowdeck is a snowskate with a single ski attached to the bottom of the board.

Sandboarding is similar to snowboarding, but the boards are adapted for use in sand dunes rather than snow covered mountains. Most sandboards will include bindings, while others do not. The base of a sandboard is much harder and sturdy than that of a snowboard, due to the more abrasive nature of sand.

U.S. Pat. No. 6,244,615 to Mendoza on Jun. 12, 2001, describes a snowboard for each foot having a turned up nose, tail, top, bottom, and core surrounded by an edge. Furthermore, the invention may include sidecuts for improved turning and stopping. While this invention does provide these benefits, the sidecuts do not provide angled sidewalls, the core extends through the nose and tail, the width of the nose and tail are the same, and the board does not have a negative camber, amongst other things.

U.S. Pat. No. 5,398,957 to Leighton on June Mar. 21, 1995, describes a boot length ski device for sliding on snow, ice, and other artificial surfaces. The device comprises a base, heel, and binding for attaching to a standard boot, as well as several surface lands and grooves for moving along the above surfaces. While the device is intended for each foot, it does not provide the benefits of the present invention such as improved stopping, turning, maneuverability, reverse camber, and the like.

While snowboards and sandboards are becoming more robust, current users are limited to traditional boards that use both feet. Therefore, a need exists for a snowboard that can offer an enhanced riding experience on snow or sand without having both feet on a single board. The present invention accomplishes these objectives.

SUMMARY OF THE INVENTION

The present invention will provide an enhanced riding experience on snow or sand without having both feet on a single board. Furthermore, the present invention will incorporate improvements in riding safety and maneuverability. This is accomplished by creating improved individual snowboards for each foot with several safety and performance improvements.

The improved individual snowboards comprise a nose, tail, top surface, bottom surface, and a tapered core. The width of the nose is larger than that of the tail. The user will stand on the boards perpendicular to the sidewalls, with each nose pointing outward and each tail pointing inward. The snowboards further incorporate angled sidewalls and a raised bottom camber for increased safety and maneuverability when riding on the snow or sand.

The tapered core will provide a safer and easier ride for the user by limiting the core to the base, and not to the nose and tail. The absence of a core allows the nose and tail to flex much easier, allowing the board to form into a better shape when pressure is applied. Furthermore, the flex will absorb much of the impact of the terrain. Lastly, the flex will absorb some impact when landing jumps and help to spring the user when launching jumps.

The difference in width between the nose and the tail will provide assistance in turning and changing stances. For example, the large width of the nose will make it easier to turn or switch from a regular stance to a goofy stance without sticking or catching the sidewall on the terrain. Furthermore, the wide width of the nose will make the board stick or catch, making it harder to turn but provide a larger surface area. Finally, the difference in width allows the user to shuffle their feet from toe to heel, propelling the board and creating momentum.

The angled sidwalls are incorporated for several safety reasons. First, they prevent objects from coming into direct contact with the sidewall of the board, instead deflecting them upward. For example, during a turn, if the user would hit a hard patch of snow, ice, or rock, a traditional sidewall would absorb all of the impact while the angled sidewalls would deflect it. Second, the angled sidewalls prevent the edge and sidewall of the board from coming into contact with excess snow, ice, rocks, or other objects that may promote de-lamination of the board.

The angled sidecuts can also assist in performance. With a larger sidecut, turning will be much easier. For example, when in a snowpark or other area where maneuverability is critical, a larger sidecut will be beneficial. When downhill racing, the sidecut can be reduced due to the absence of hard turning.

The raised camber will provide a smoother ride for the user, while also adding more edge for better stopping, turning, and control. Also, when weight is applied to the snowboard, the camber will flatten, preventing the board from digging into the snow and providing a larger surface area. This aids in stopping, turning, and speed. Furthermore, the camber will provide a "shock absorption" when doing tricks and jumps.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
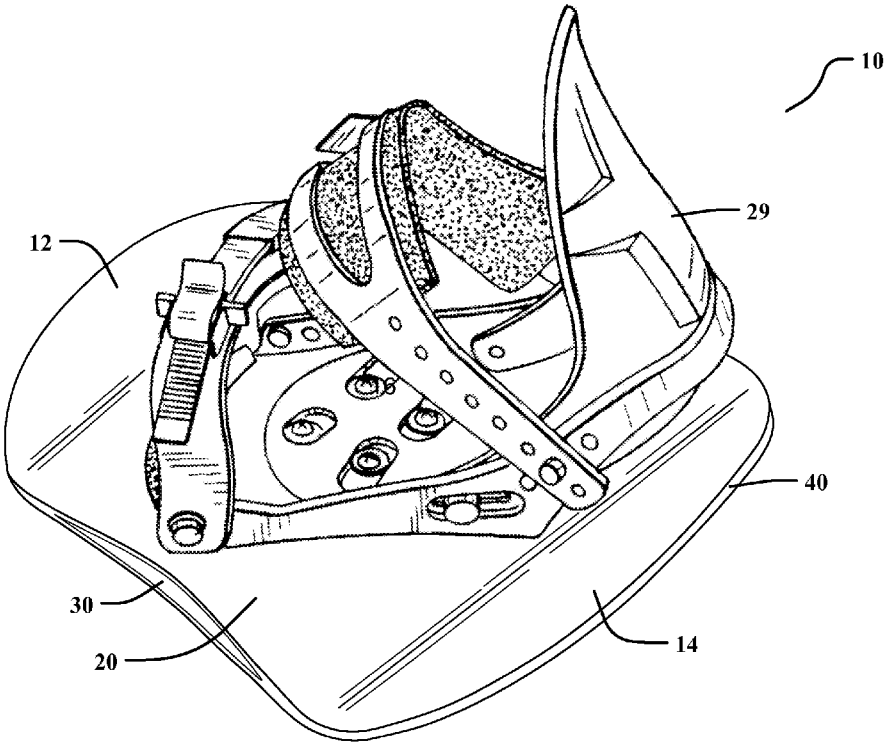
FIG. 1 is a perspective view of the invention with a snow boot.
Figure 2:
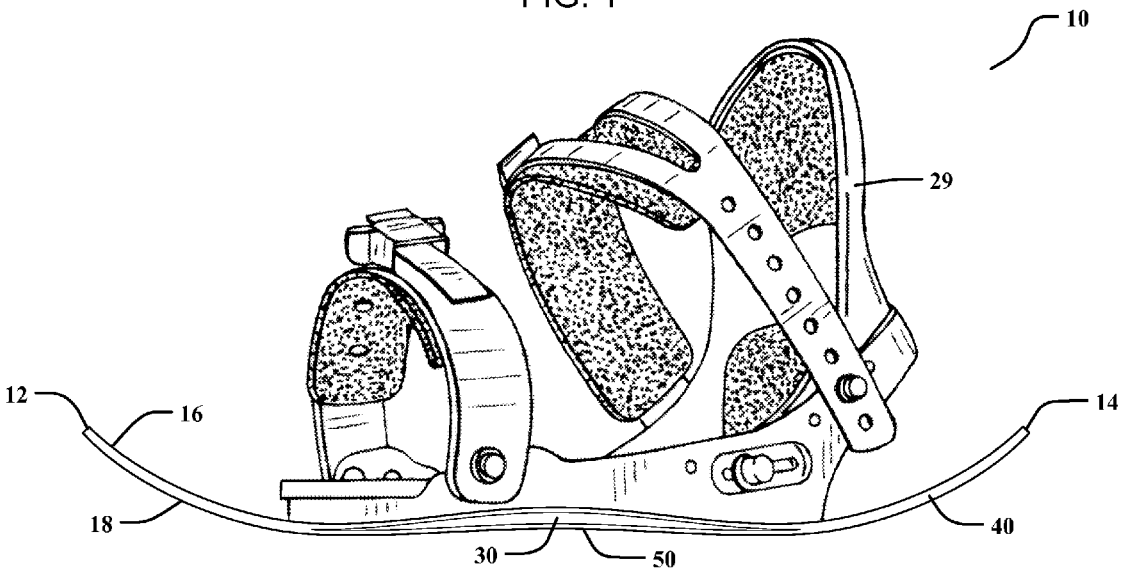
FIG. 2 is a side view of the invention with a snow boot.
Figure 3:
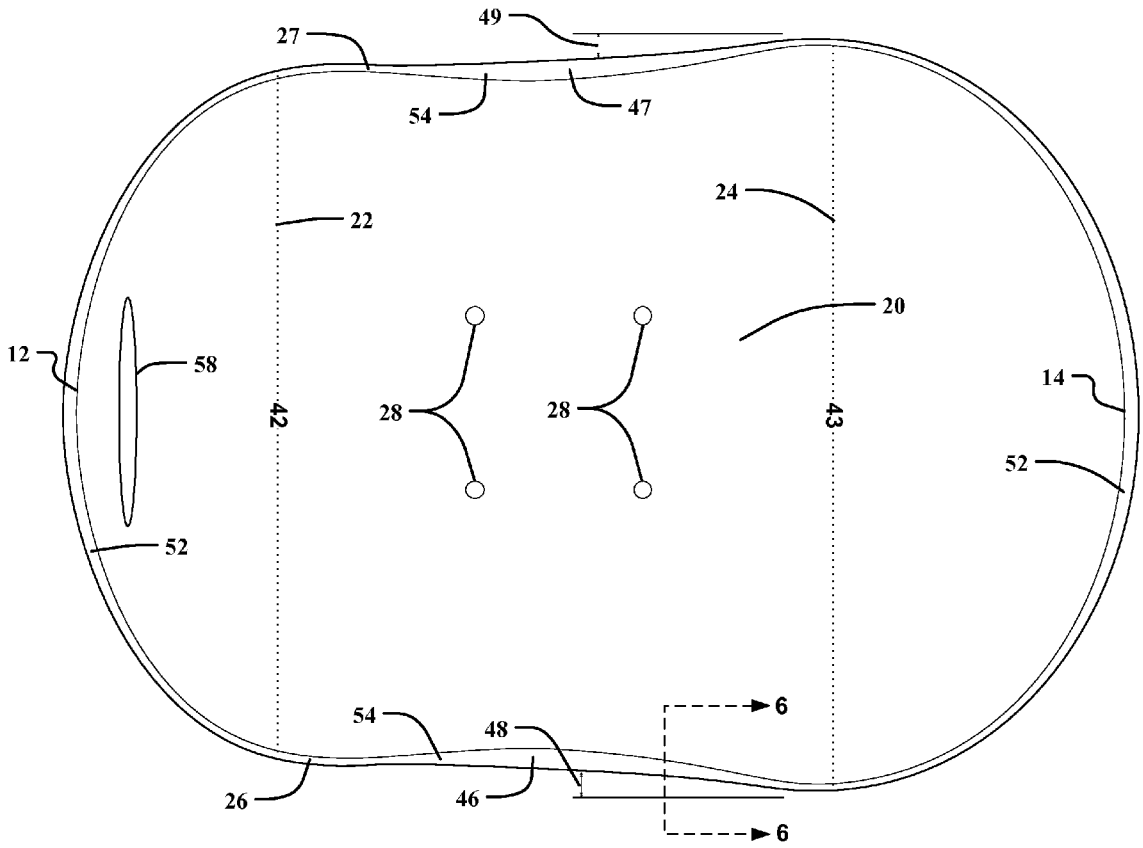
FIG. 3 is a top view of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention provides an improved individual snowboard 10 for each foot. Each individual snowboard 10 comprises a resilient body having a curved up front nose 12, a curved up rear tail 14, a top surface 16, and a bottom surface 18. A base 20 is defined as the area between the front nose 12 and the rear tail 14. A front contact line 22 is defined as the line between the base 20 and the front nose 12, and a rear contact line 24 is defined as the line between the base 20 and the rear tail 14. Left and right sidewalls 26, 27 extend from their respective ends of the front and rear contact lines, 22 and 24. Four boot binding holes 28 are on the base 20 for attaching a snowboard boot 29 to the improved individual snowboard 10.

An oblong rectangular core 30 is disposed within the top surface 16 and the bottom surface 18 of the base 20 only. The core 30 has a top core surface 32 and a bottom core surface 34, where the area of the top core surface 32 is smaller than the area of the bottom core surface 34 due to tapering 36 of the longer sides 38 of the top core surface 32. The core 30 does not extend through the nose 12 and tail 14, providing more flexibility in the nose 12 and tail 14 than in the base 20. Four holes 39 are on the core 30 aligning with the four holes for the boot bindings 28.

The length 42 of the front contact line 22 is longer than the length 43 of the rear contact line 24. As such, the width of the nose 12 is larger than the width of the tail 14. This creates a generally isosceles trapezoidal shape (without considering sidecuts 46, 47) between the front contact line 22, rear contact line 14, left sidewall 26, and right sidewall 27 when viewed from the top of the improved individual snowboard 10. The ratio of length 42 of the front contact line 22 to the length 43 of the rear contact line 24 is 5:4. Furthermore, the nose 12 and tail 14 have equal displacements 44, 45 above the base 20. Alternatively, the nose 112 is higher than the tail 114, or has a greater displacement 144 than the displacement 145 of the tail 114.

Left and right sidecuts 46, 47 are formed along the left and right sidewalls, 26, 27, respectively. The left sidecut 46 is formed as an inward deflection 48 of the left sidewall 26 and the right sidecut 47 is formed as an inward deflection 49 of the right sidewall 27. The minimum and maximum deflection 48, 49 of both sidecuts 46, 47 is in the range of 0.1 inch to 1 inch.

Figure 4:
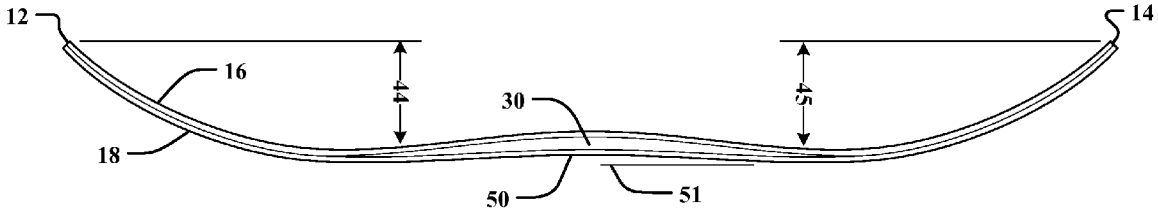
FIG. 4 is a side view of the invention.
Figure 5:
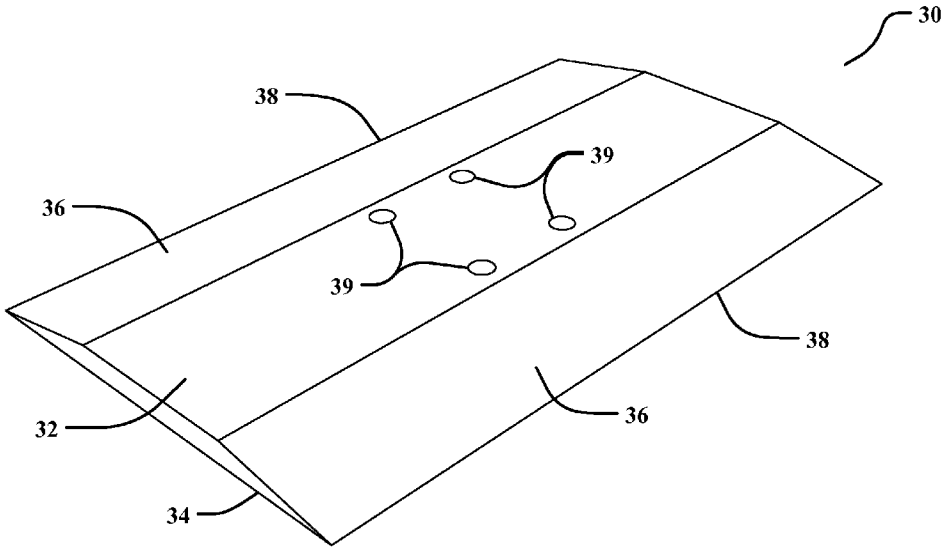
FIG. 5 is a perspective view of the core as shown in FIG. 1.
Figure 6:
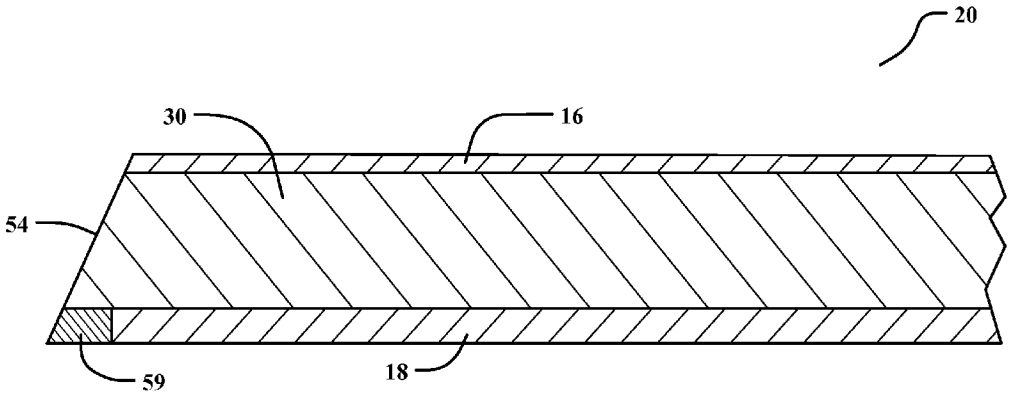
FIG. 6 is a cross-sectional view of the invention along line 6-6 of FIG. 3.

The base 20 has a concave shape 50 when viewed from the side (FIG. 4), defined as a raised camber or upward bend. As such, when the improved individual snowboard 10 is laid on a flat surface, the contact lines 22, 24 are the only contact points on the bottom surface 18. When the rider applies their body weight on the improved individual snowboard 10, however, the concave shape 50 will flatten, resulting in a larger contact surface but still less of the center of the improved individual snowboard 10 coming into contact with the snow. The displacement 51 of the concave shape 50 is in the range of 0.1 inch to 1 inch without user weight, and 0 inches to 0.1 inches with user weight.

A common sidewall 40 is formed along the perimeter of the front nose 12, the rear tail 14, the left sidewall 26, and the right sidewall 27. While the improved individual snowboard 10 shares a common sidewall 40, the angle and thickness of the common sidewall 40 will vary. Along the nose 12 and tail 14, the common sidewall 40 will have a substantially right angle 52 at the intersection of the bottom and top surfaces 16, 18, and a lower thickness due to the lack of the core 30. Along the left and right sidewalls 26, 27, the common sidewall 40 will have an acute angle 54 at the intersection of the bottom surface 18, and a higher thickness due to the presence of the core 30. The acute angle 54 can range from 30 degrees to 60 degrees. The common sidewall 40 further comprises an inset metal strip 59 along the perimeter adjacent to the bottom surface 18 capable of being sharpened and holding a edge.

The core 30 is formed of resilient material capable of providing rigidity to the snowboard and securing mounting of a snowboard boot binding 29. The core 30 can be made from a material such as ABS, hard plastics, wood, fiberglass, aluminum, foam, composite honeycomb with resin, or any other lightweight yet sturdy material, and can range from 1/16" to 2" thick. The sidewall 40 can be made from fiberglass, or other protective laminate. The metal strip 59 can be made of stainless steel, metal composites, or other durable, water resistant metals capable of being sharpened.

The top and bottom surfaces 16, 18, extend from the nose 12 through the tail 14. The top surface 16 can be made from fiberglass, plastic, or other protective laminate. The bottom surface 18 will come in contact with the snow surface, and a low friction, or 'slippery' surface, is desirable. As such, the bottom surface 18 can be made from urethane plastic, polyurethane and ABS, fiberglass, or other porous material. Wax is commonly applied to the bottom surface 18 to further reduce friction.

Figure 7:
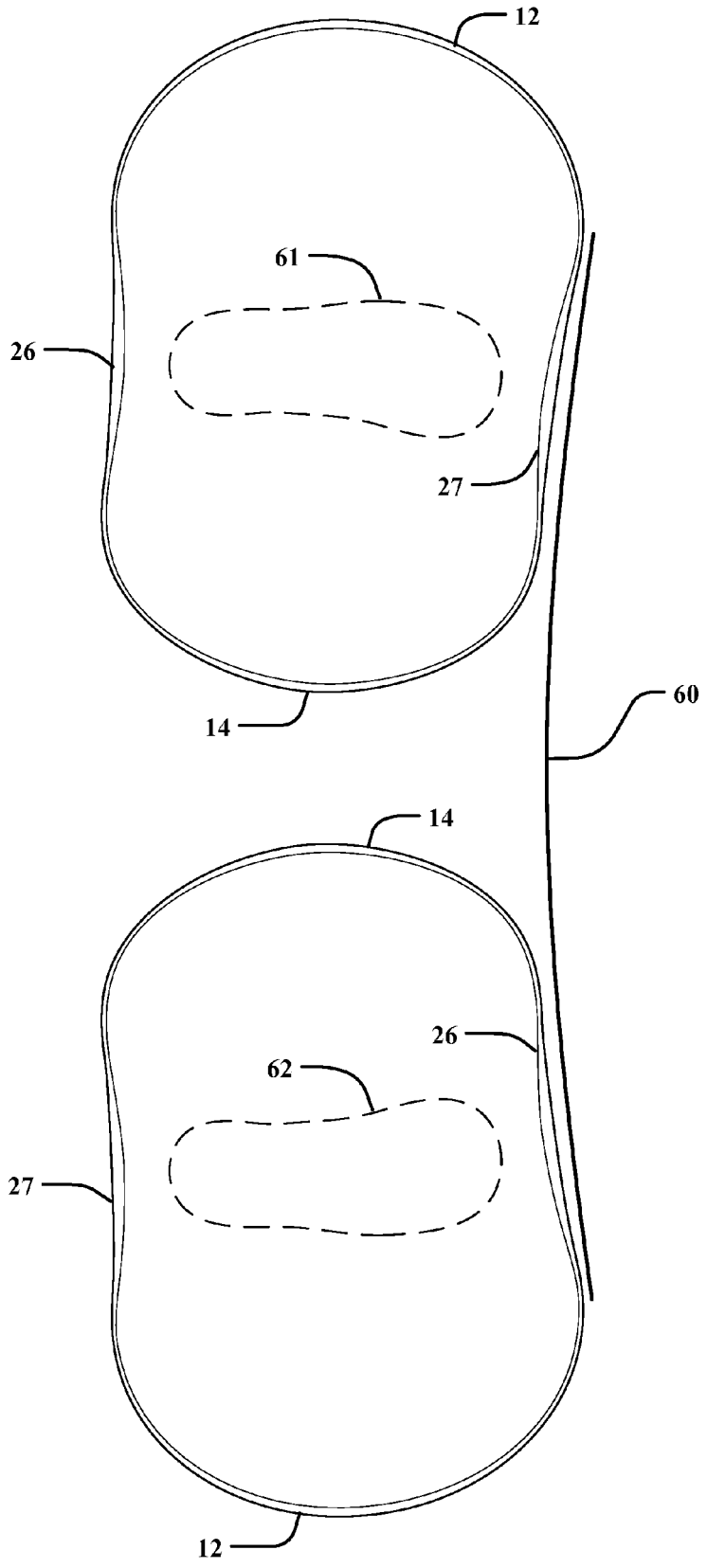
FIG. 7 is a top view of the invention illustrating the continuous sidecut.
Figure 8:
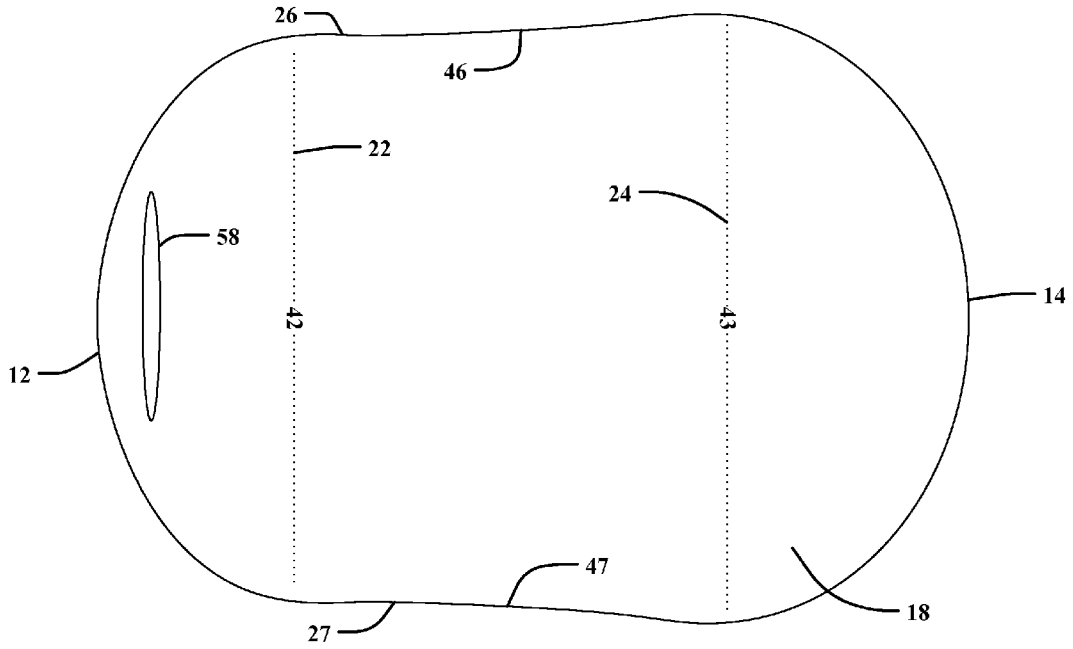
FIG. 8 is a bottom view of the invention.
Figure 9:
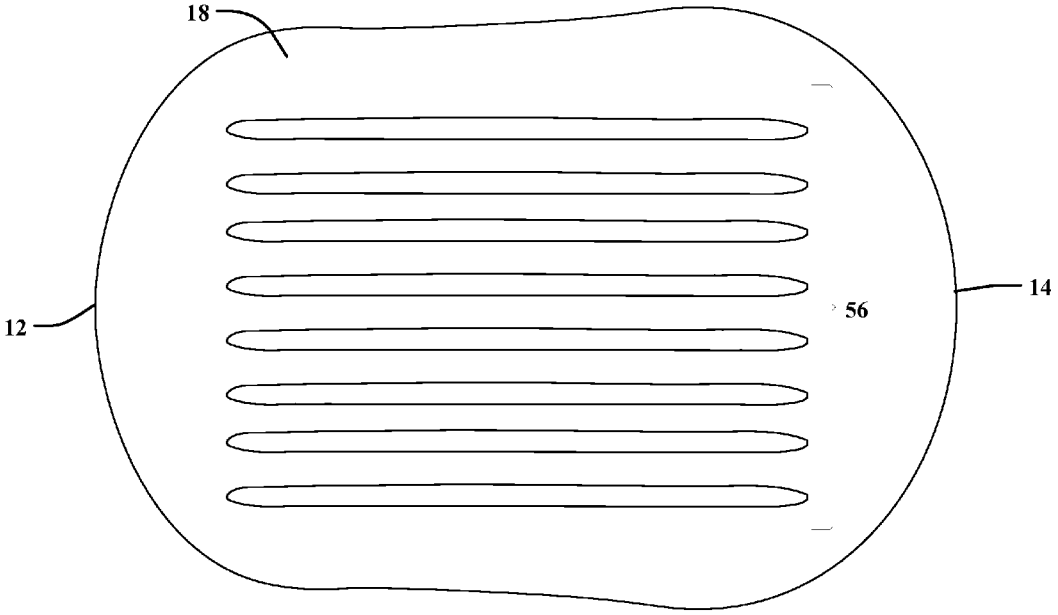
FIG. 9 is a bottom view of the invention with channels.
Figure 10:
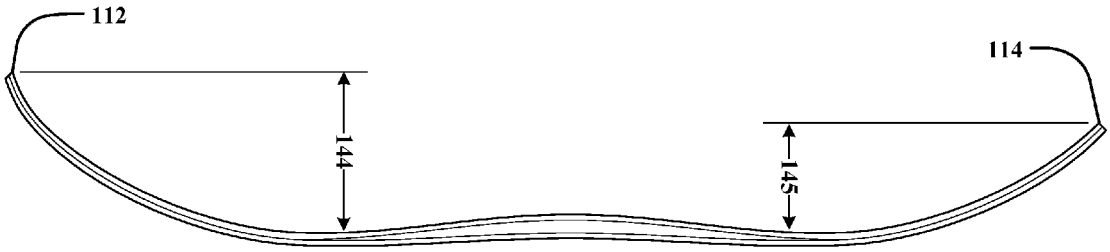
FIG. 10 is a side view of the invention with an extended nose.

FIG. 7 describes the method of using the individual snowboards 10. When using the individual snowboards 10, the user will stand on both boards 10 perpendicular to the sidewalls 26, 27, with each nose 12 pointing outward and each tail 14 pointing inward. Specifically, and from the user's perspective, the left foot 61 will have the nose 12 pointing left and the user's right foot 62 will have the nose 12 pointing right. As such, the individual snowboards 10 will imitate a traditional snowboard having a continuous sidecut 60. From this position, the user can alter their stance and otherwise take advantage of having individual snowboards 10 on each foot.

In an alternative embodiment, the improved individual snowboard 10 will be adapted for land use (sand, dirt, grass, water, etc). Here, the core 30 will be made of foam, ABS, or wood, the boot bindings 29 will be replaced with inserts and straps (not pictured), and the bottom surface 18 will be made of Formica (for land), urethane plastic (for water), or fiberglass mixed with epoxies (for water) use. A plurality of channels 56 may be placed on the bottom surface 18 of the improved individual snowboard 10 at an angle to a long axis of the snowboard 10 if intended as snowskates, snowdecks, and sandskates, and fins can be added to the base for use on water (not shown). A range of 4 to 9 channels 54 may be used, spaced approximately 1 inch apart.

The preferred embodiment will have a width in the range of 6 to 18 inches, and the length of the entire improved individual snowboard 10 is in the range of 6 inches to 18 inches. The thickness of the sidewall ranges from 1/16" to 2" from the nose 12 and tail 14 to the base 20, respectively. A strap hole 58 will be placed on the rear tail 14 to hang the improved individual snowboard 10 together for storage, or for connecting the individual boards 10 for training purposes.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

What is claimed is:

1. An improved individual snowboard for each foot, comprising:

a resilient body having a curved up front nose, a curved up rear tail, a top surface, and a bottom surface;

a base between said front nose and said rear tail, said base having a generally concave shape;

a front contact line between said front nose and said base;

a rear contact line between said rear tail and said base;

left and right sidewalls extending from their respective ends of said front and rear contact lines;

an oblong rectangular core disposed between said base, said top surface and said bottom surface;

a top core surface and a bottom core surface, said top core surface tapering to said bottom core surface on its longer sides, said longer sides perpendicular to said left and right sidewalls;

a plurality of apertures on said core aligning with said plurality of snowboard boot binding holes on said base;

a common sidewall along the perimeter of said front nose, said rear tail, said left sidewall, and said right sidewall;

a plurality of snowboard boot binding holes on said base; and a snowboard boot binding mounted using said boot binding holes;

wherein each of said snowboards are between 6 inches and 18 inches in length.

2. The improved individual snowboard for each foot of claim 1, further comprising:

a left sidecut being formed as an inward deflection of said left sidewall; and a right sidecut being formed as an inward deflection of said ride sidewall.

3. The improved individual snowboard for each foot of claim 1, further comprising said front and rear contact lines being the only contact points when laid on a flat surface, and said concave base flattening with the weight of the user.

4. The improved individual snowboard for each foot of claim 1, wherein said core further comprises resilient ABS plastic capable of providing rigidity to said base and mounting of said snowboard boot binding.

5. The improved individual snowboard for each foot of claim 1, further comprising equal displacements of said front nose and said rear tail above said base.

6. The improved individual snowboard for each foot of claim 1, further comprising a larger displacement of said front nose than that of said rear tail relative to said base.

7. The improved individual snowboard for each foot of claim 1, wherein said front nose and said rear tail are more flexible than said base.

8. The improved individual snowboard for each foot of claim 1, wherein said common sidewall further comprises an inset metal strip along said perimeter adjacent to said bottom surface, said inset metal strip capable of being sharpened and holding an edge.

9. The improved individual snowboard for each foot of claim 1, further comprising a plurality of equally spaced channels on said bottom surface of said base at an angle to a long axis of the improved individual snowboard.

10. The improved individual snowboard for each foot of claim 1, further comprising an aperture within said front nose capable of accommodating a strap therethrough.

11. The improved individual snowboard for each foot of claim 2, further comprising a length of said front contact line longer than a length of said rear contact line.

12. The improved individual snowboard for each foot of claim 11, further comprising:

said inward deflection of said left sidecut in the range of 0.1 inch to 1 inch;

said inward deflection of said right sidecut in the range of 0.1 inch to 1 inch; and the ratio of length of said front contact line to said rear contact line is 5:4.

13. The improved individual snowboard for each foot of claim 3, further comprising:

the displacement of said concave base above said front and rear contact lines is in the range of 0.1 inch to 1 inch at rest; and the displacement of said concave base above said front and rear contact lines is in the range of 0 inches to 0.1 inches with user weight.

14. The improved individual snowboard for each foot of claim 8, wherein said common sidewall further comprises:

a substantially right angle at the intersection of said bottom surface and each of said front nose and rear tail; and an acute angle at the intersection of said bottom surface and each of said left and right sidewalls.

15. The improved individual snowboard for each foot of claim 14, wherein said acute angle further comprises a range of 30 degrees to 60 degrees.

16. The improved individual snowboard for each foot of claim 9, wherein said plurality of channels comprises a range from 4 to 9 channels.

17. The improved individual snowboard for each foot of claim 9, wherein said core further comprises resilient foam or foam composite capable of providing rigidity to said base and mounting of said snowboard boot binding.

18. The improved individual snowboard for each foot of claim 9, wherein said core further comprises resilient wood capable of providing rigidity to said base and mounting of said snowboard boot binding.

19. The method of using the improved individual snowboard for each foot comprising the steps of:

a) placing each foot on a separate individual snowboard perpendicular to the sidewalls, and;

b) pointing the front nose of each individual snowboard outward and each rear tail of each individual snowboard inward, creating a continuous sidecut;

the individual snowboard comprising:

a resilient body having a curved up front nose, a curved up rear tail, a top surface, and a bottom surface;

a base between said front nose and said rear tail, said base having a generally concave shape;

a front contact line between said front nose and said base;

a rear contact line between said rear tail and said base;

left and right sidewalls extending from their respective ends of said front and rear contact lines;

an oblong rectangular core disposed between said base, said top surface and said bottom surface;

a common sidewall along the perimeter of said front nose, said rear tail, said left sidewall, and said right sidewall;

a plurality of snowboard boot binding holes on said base;

a snowboard boot binding mounted using said boot binding holes;

each of said snowboards being between 6 inches and 18 inches in length;

a left sidecut being formed as an inward deflection of said left sidewall in the range of 0.1 inch to 1 inch;

a right sidecut being formed as an inward deflection of said ride sidewall in the range of 0.1 inch to 1 inch;

a length of said front contact line longer than a length of said rear contact line;

the ratio of length of said front contact line to said rear contact line is 5:4;

the displacement of said concave base above said front and rear contact lines is in the range of 0.1 inch to 1 inch at rest;

the displacement of said concave base above said front and rear contact lines is in the range of 0 inches to 0.1 inches with user weight;

a top core surface and a bottom core surface, said top core surface tapering to said bottom core surface on its longer sides, said longer sides perpendicular to said left and right sidewalls;

a plurality of apertures on said core aligning with said plurality of snowboard boot binding holes on said base;

equal displacements of said front nose and said rear tail above said base;

an inset metal strip along said perimeter adjacent to said bottom surface, said inset metal strip capable of being sharpened and holding an edge;

a substantially right angle at the intersection of said bottom surface and each of said front nose and rear tail;

an acute angle at the intersection of said bottom surface and each of said left and right sidewalls; and said acute having a range of 30 degrees to 60 degrees;

wherein said front nose and said rear tail are more flexible than said base.

* * * * *